US006956577B2

(12) United States Patent
Radke et al.

(10) Patent No.: US 6,956,577 B2
(45) Date of Patent: Oct. 18, 2005

(54) EMBEDDED MEMORY SYSTEM AND METHOD INCLUDING DATA ERROR CORRECTION

(75) Inventors: William Radke, San Francisco, CA (US); Atif Sarwari, Saratoga, CA (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/813,184

(22) Filed: Mar. 29, 2004

(65) Prior Publication Data

US 2004/0183808 A1 Sep. 23, 2004

Related U.S. Application Data

(63) Continuation of application No. 09/974,364, filed on Oct. 9, 2001, now Pat. No. 6,741,253.

(51) Int. Cl.[7] ..... G09G 5/39

(52) U.S. Cl. ..... 345/531; 345/558; 345/561; 345/565; 711/155; 714/764; 714/766

(58) Field of Search ..... 345/531, 558, 345/561, 565; 711/108, 155; 714/48, 764, 766

(56) References Cited

U.S. PATENT DOCUMENTS

| | | | | |
|---|---|---|---|---|
| 5,353,402 A | | 10/1994 | Lau | 395/162 |
| 5,809,228 A | | 9/1998 | Langendorf et al. | 395/185.06 |
| 5,831,673 A | | 11/1998 | Przyborski et al. | 348/239 |
| 5,860,112 A | | 1/1999 | Langendorf et al. | 711/143 |
| 5,924,117 A | | 7/1999 | Luick | 711/127 |
| 5,987,628 A | | 11/1999 | Von Bokern et al. | 714/48 |
| 6,002,412 A | | 12/1999 | Schinnerer | 345/521 |
| 6,112,265 A | | 8/2000 | Harriman et al. | 710/40 |
| 6,115,837 A | | 9/2000 | Nguyen et al. | 714/769 |
| 6,150,679 A | | 11/2000 | Reynolds | 257/213 |
| 6,151,658 A | | 11/2000 | Magro | 711/110 |
| 6,167,551 A | * | 12/2000 | Nguyen et al. | 714/770 |
| 6,272,651 B1 | | 8/2001 | Chin et al. | 714/43 |
| 6,279,135 B1 | * | 8/2001 | Nguyen et al. | 714/769 |
| 6,366,984 B1 | | 4/2002 | Carmean et al. | 711/141 |
| 6,401,168 B1 | | 6/2002 | Williams et al. | 711/112 |
| 6,470,433 B1 | | 10/2002 | Prouty et al. | 711/168 |
| 6,523,110 B1 | | 2/2003 | Bright et al. | 712/239 |
| 6,587,112 B1 | | 7/2003 | Goeltzenleuchter et al. | 345/532 |
| 6,784,889 B1 | * | 8/2004 | Radke | 345/531 |
| 2001/0019331 A1 | * | 9/2001 | Nielsen et al. | 345/542 |

* cited by examiner

*Primary Examiner*—Ulka J. Chauhan
(74) *Attorney, Agent, or Firm*—Dorsey & Whitney LLP

(57) ABSTRACT

A system and method for accessing a memory array where retrieved data is stored in a memory and upon the writing of the data in its modified form, the originally stored data is updated with the modification prior to being written back to the memory array. In this manner, a new error correction code can be calculated prior to writing the data without the need to access the memory array again.

15 Claims, 3 Drawing Sheets

EMBEDDED MEMORY SYSTEM AND METHOD INCLUDING DATA ERROR CORRECTION

CROSS-REFERENCE TO RELATED APPLICATION

This application is a continuation of U.S. patent application Ser. No. 09/974,364, filed Oct. 9, 2000 now U.S. Pat. No. 6,741,253.

TECHNICAL FIELD

The present invention is related generally to the field of computer graphics, and more particularly, to an embedded memory system and method having efficient utilization of read and write bandwidth of a computer graphics processing system.

BACKGROUND OF THE INVENTION

Graphics processing systems often include embedded memory to increase the throughput of processed graphics data. Generally, embedded memory is memory that is integrated with the other circuitry of the graphics processing system to form a single device. Including embedded memory in a graphics processing system allows data to be provided to processing circuits, such as the graphics processor, the pixel engine, and the like, with low access times. The proximity of the embedded memory to the graphics processor and its dedicated purpose of storing data related to the processing of graphics information enable data to be moved throughout the graphics processing system quickly. Thus, the processing elements of the graphics processing system may retrieve, process, and provide graphics data quickly and efficiently, increasing the processing throughput.

Processing operations that are often performed on graphics data in a graphics processing system include the steps of reading the data that will be processed from the embedded memory, modifying the retrieved data during processing, and writing the modified data back to the embedded memory. This type of operation is typically referred to as a read-modify-write (RMW) operation. The processing of the retrieved graphics data is often done in a pipeline processing fashion, where the processed output values of the processing pipeline are rewritten to the locations in memory from which the pre-processed data provided to the pipeline was originally retrieved. Examples of RMW operations include blending multiple color values to produce graphics images that are composites of the color values and Z-buffer rendering, a method of rendering only the visible surfaces of three-dimensional graphics images.

In conventional graphics processing systems including embedded memory, the memory is typically a single-ported memory. That is, the embedded memory either has only one data port that is multiplexed between read and write operations, or the embedded memory has separate read and write data ports, but the separate ports cannot be operated simultaneously. Consequently, when performing RMW operations, such as described above, the throughput of processed data is diminished because the single ported embedded memory of the conventional graphics processing system is incapable of both reading graphics data that is to be processed and writing back the modified data simultaneously. In order for the RMW operations to be performed, a write operation is performed following each read operation. Thus, the flow of data, either being read from or written to the embedded memory, is constantly being interrupted. As a result, full utilization of the read and write bandwidth of the graphics processing system is not possible.

One approach to resolving this issue is to design the embedded memory included in a graphics processing system to have dual ports. That is, the embedded memory has both read and write ports that may be operated simultaneously. Having such a design allows for data that has been processed to be written back to the dual ported embedded memory while data to be processed is read. However, providing the circuitry necessary to implement a dual ported embedded memory significantly increases the complexity of the embedded memory and requires additional circuitry to support dual ported operation. As space on an graphics processing system integrated into a single device is at a premium, including the additional circuitry necessary to implement a multi-port embedded memory, such as the one previously described, may not be an reasonable alternative.

Another issue that can further complicate efficient utilization of read write memory bandwidth is implementing an error correction code (ECC) scheme in an embedded memory system. In general, ECCs are used to maintain the integrity of data written to memory, and can, in some instances when an error in the data is detected, correct the errors. In operation, when data are written to memory, a calculation is performed on the data to produce a code. The code, which is stored with the data, is used to detect and correct errors in the data. When the data is read from memory, the code calculation is once again performed on the retrieved data, and the resulting code is compared with the code that was stored with the data. Ideally, the two codes are the same, indicating that the data has not changed since being written to memory. However, if the two codes are different, an error in the data has occurred, and, through the use of the code, a corrected set of data may be produced. Thus, although the data retrieved from memory may have an error, the data that is actually provided to a requesting entity will be correct. In the case the error in the data cannot be corrected by the code, the condition is reported.

The general use of ECC techniques in memory systems is known in the art. For example, use of Hamming codes, Reed-Solomon codes, and the like, for ECC is well understood. Such techniques have been used at various memory levels, including at the embedded memory level. However, these ECC schemes are generally cumbersome and negatively impact memory access rates. In systems where high data read and write throughput is desired, overcoming these issues while maintaining data throughput becomes a daunting proposition.

Therefore, there is a need for a method and embedded memory system having ECC capability that can utilize the read and write bandwidth of a graphics processing system more efficiently during a read-modify-write processing operation.

SUMMARY OF THE INVENTION

The present invention is directed to a system and method for accessing a memory array where retrieved data is stored in a memory and upon the writing of the data in its modified form, the originally stored data is updated with the modification prior to being written back to the memory array. In this manner, a new error correction code can be calculated prior to writing the data without the need to access the memory array again. The system includes a memory having a plurality of memory locations for storing data in a first-in-first-out (FIFO) manner, a content addressable memory (CAM) coupled to the memory and having an input to receive memory addresses and having a plurality of memory locations for storing memory addresses, each of which corresponds to a memory location of the memory. The CAM provides an activation signal to access a memory location of the memory in response to receiving a memory address matching the corresponding stored memory address. The system further includes a first switch coupled to the output of the memory to selectively couple the output of the memory to the write bus or an output bus, a combining circuit having a first input, a second input coupled to the output of the memory, and further having an output coupled to the input of the memory, the combining circuit combining data applied to the first and second inputs and providing the result at the output, and a second switch to selectively couple the first input of the combining circuit to the read bus or an input bus. A FIFO control circuit is coupled to the combining circuit, the first and second switches, and the memory. In response to receiving a read request, the FIFO control circuit coordinates the storing of the requested data in the memory and providing the requested data to the output bus, and in response to receiving a write request, the FIFO control circuit coordinates the combining of modified data received from the input bus with corresponding original data previously stored in the memory and providing the combined data for error correction code calculation and writing to the location in the memory array from where the corresponding original data was originally read.

DETAILED DESCRIPTION OF THE INVENTION

Embodiments of the present invention provide a memory system and method having error correction capability that allows for efficient read-modify-write operations and error correction code calculation. Certain details are set forth below to provide a sufficient understanding of the invention. However, it will be clear to one skilled in the art that the invention may be practiced without these particular details. In other instances, well-known circuits, control signals, timing protocols, and software operations have not been shown in detail in order to avoid unnecessarily obscuring the invention.

Figure 1:
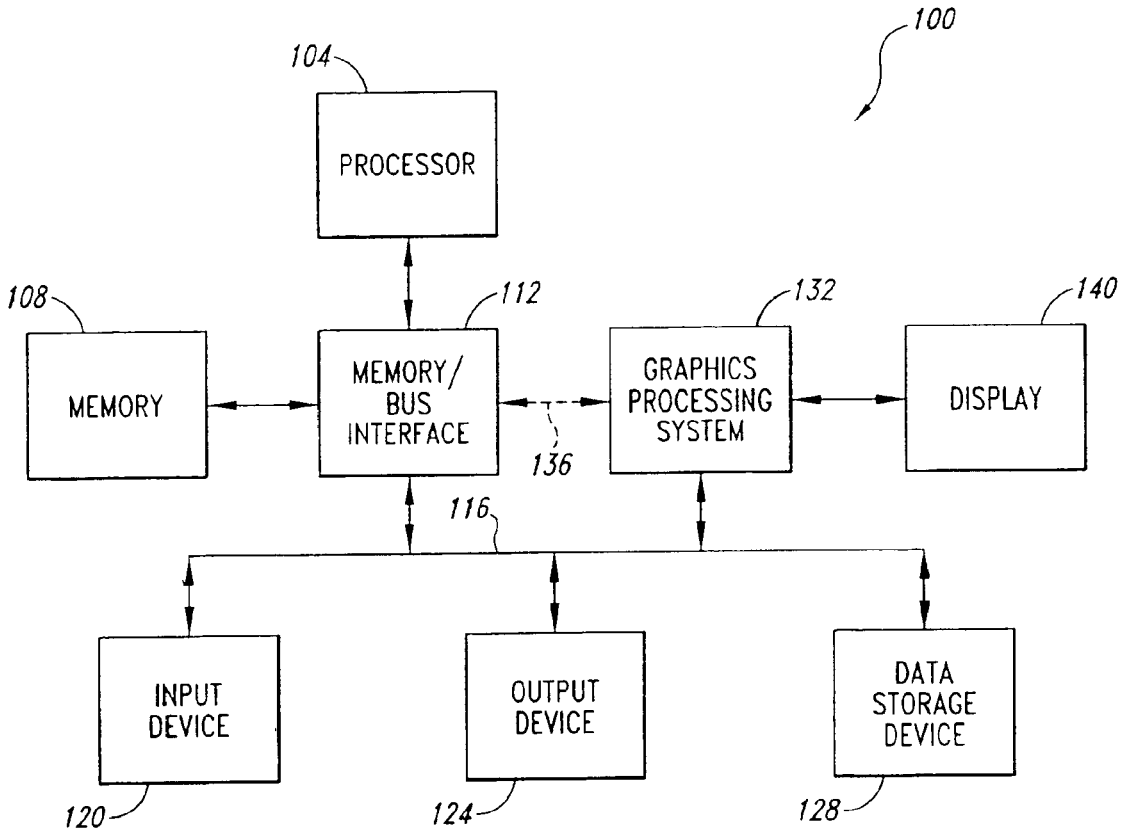
FIG. 1 is a block diagram of a system in which embodiments of the present invention may be implemented.

FIG. 1 illustrates a computer system 100 in which embodiments of the present invention may be implemented. The computer system 100 includes a processor 104 coupled to a memory 108 through a memory/bus interface 112. The memory/bus interface 112 is coupled to an expansion bus 116, such as an industry standard architecture (ISA) bus or a peripheral component interconnect (PCI) bus. The computer system 100 also includes one or more input devices 120, such as a keypad or a mouse, coupled to the processor 104 through the expansion bus 116 and the memory/bus interface 112. The input devices 120 allow an operator or an electronic device to input data to the computer system 100. One or more output devices 124 are coupled to the processor 104 to receive output data generated by the processor 104. The output devices 124 are coupled to the processor 104 through the expansion bus 116 and memory/bus interface 112. Examples of output devices 124 include printers and a sound card driving audio speakers. One or more data storage devices 128 are coupled to the processor 104 through the memory/bus interface 112 and the expansion bus 116 to store data in, or retrieve data from, storage media (not shown). Examples of storage devices 128 and storage media include fixed disk drives, floppy disk drives, tape cassettes and compact-disc read-only memory drives.

The computer system 100 further includes a graphics processing system 132 coupled to the processor 104 through the expansion bus 116 and memory/bus interface 112. Optionally, the graphics processing system 132 may be coupled to the processor 104 and the memory 108 through other types of architectures. For example, the graphics processing system 132 may be coupled through the memory/bus interface 112 and a high speed bus 136, such as an accelerated graphics port (AGP), to provide the graphics processing system 132 with direct memory access (DMA) to the memory 108. That is, the high speed bus 136 and memory bus interface 112 allow the graphics processing system 132 to read and write memory 108 without the intervention of the processor 104. Thus, data may be transferred to, and from, the memory 108 at transfer rates much greater than over the expansion bus 116. A display 140 is coupled to the graphics processing system 132 to display graphics images. The display 140 may be any type of display, such as those commonly used for desktop computers, portable computers, and workstations, for example, a cathode ray tube (CRT), a field emission display (FED), a liquid crystal display (LCD), or the like.

Figure 2:
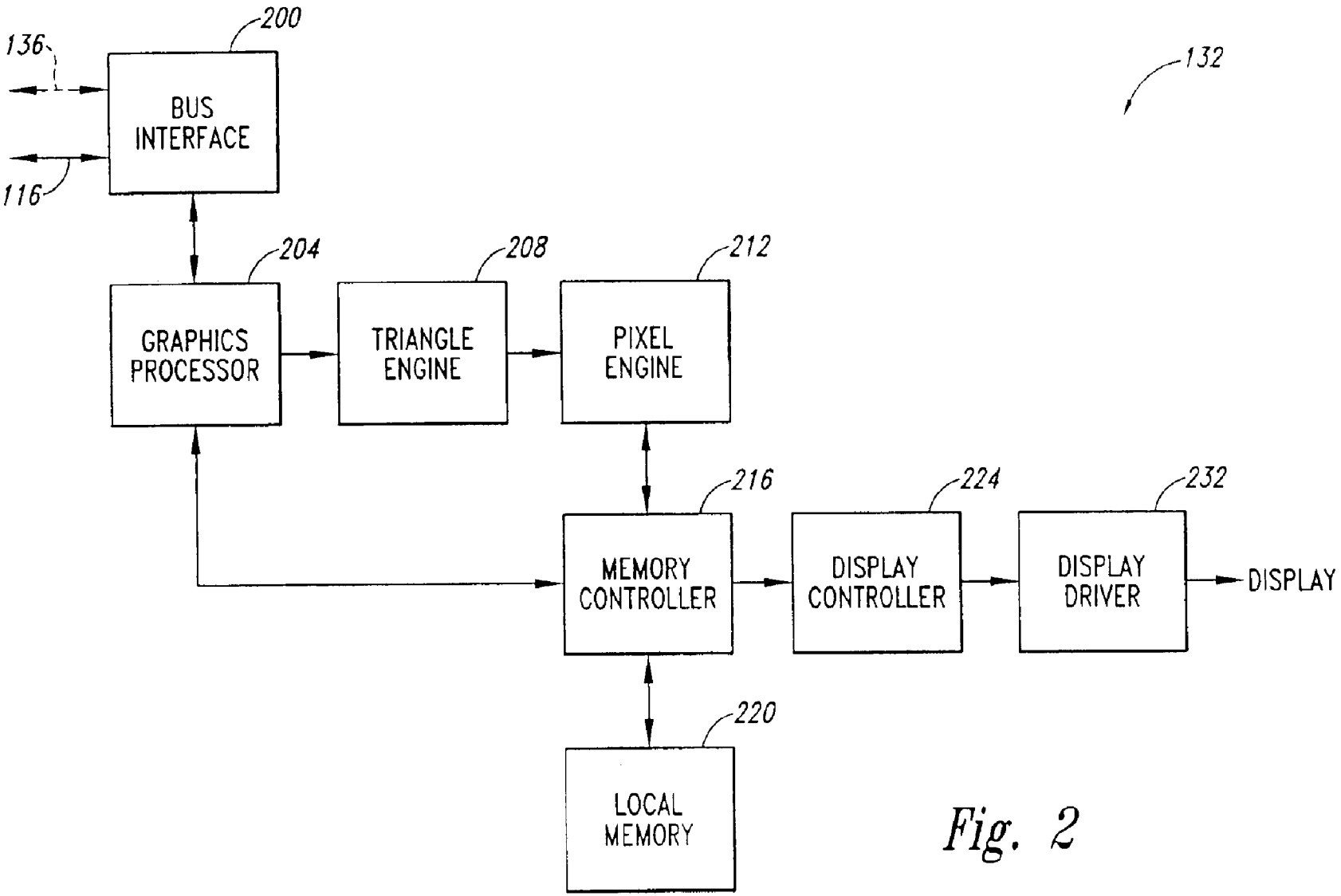
FIG. 2 is a block diagram of a graphics processing system in the system of FIG. 1.

FIG. 2 illustrates circuitry included within the graphics processing system 132 for performing various graphics and video functions. As shown in FIG. 2, a bus interface-200 couples the graphics processing system 132 to the expansion bus 116 and optionally high-speed bus 136. In the case where the graphics processing system 132 is coupled to the processor 104 and the memory 108 through the high speed data bus 136 and the memory/bus interface 112, the bus interface 200 will include a DMA controller (not shown) to coordinate transfer of data to and from the host memory 108 and the processor 104. A graphics processor 204 is coupled to the bus interface 200 and is designed to perform various graphics and video processing functions, such as, but not limited to, generating vertex data and performing vertex transformations for polygon graphics primitives that are used to model 3D objects. The graphics processor 204 is coupled to a triangle engine 208 that includes circuitry for performing various graphics functions, such as clipping, attribute transformations, rendering of graphics primitives, and generating texture coordinates for a texture map.

A pixel engine 212 is coupled to receive the graphics data generated by the triangle engine 208. The pixel engine 212 contains circuitry for performing various graphics functions, such as, but not limited to, texture application or mapping, bilinear filtering, fog, blending, and color space conversion. A memory controller 216 coupled to the pixel engine 212 and the graphics processor 204 handles memory requests to and from a local memory 220. The local memory 220 stores graphics data, such as pixel values. A display controller 224 is coupled to the memory controller 216 to receive processed values for pixels that are to be displayed. The output values from the display controller 224 are subsequently provided to a display driver 232 that includes circuitry to provide digital signals, or convert digital signals to analog signals, to drive the display 140 (FIG. 1). It will be appreciated that the circuitry included in the graphics processing system 132 to practice embodiments of the present invention may be of conventional designs well understood by those of ordinary skill in the art.

Figure 3:
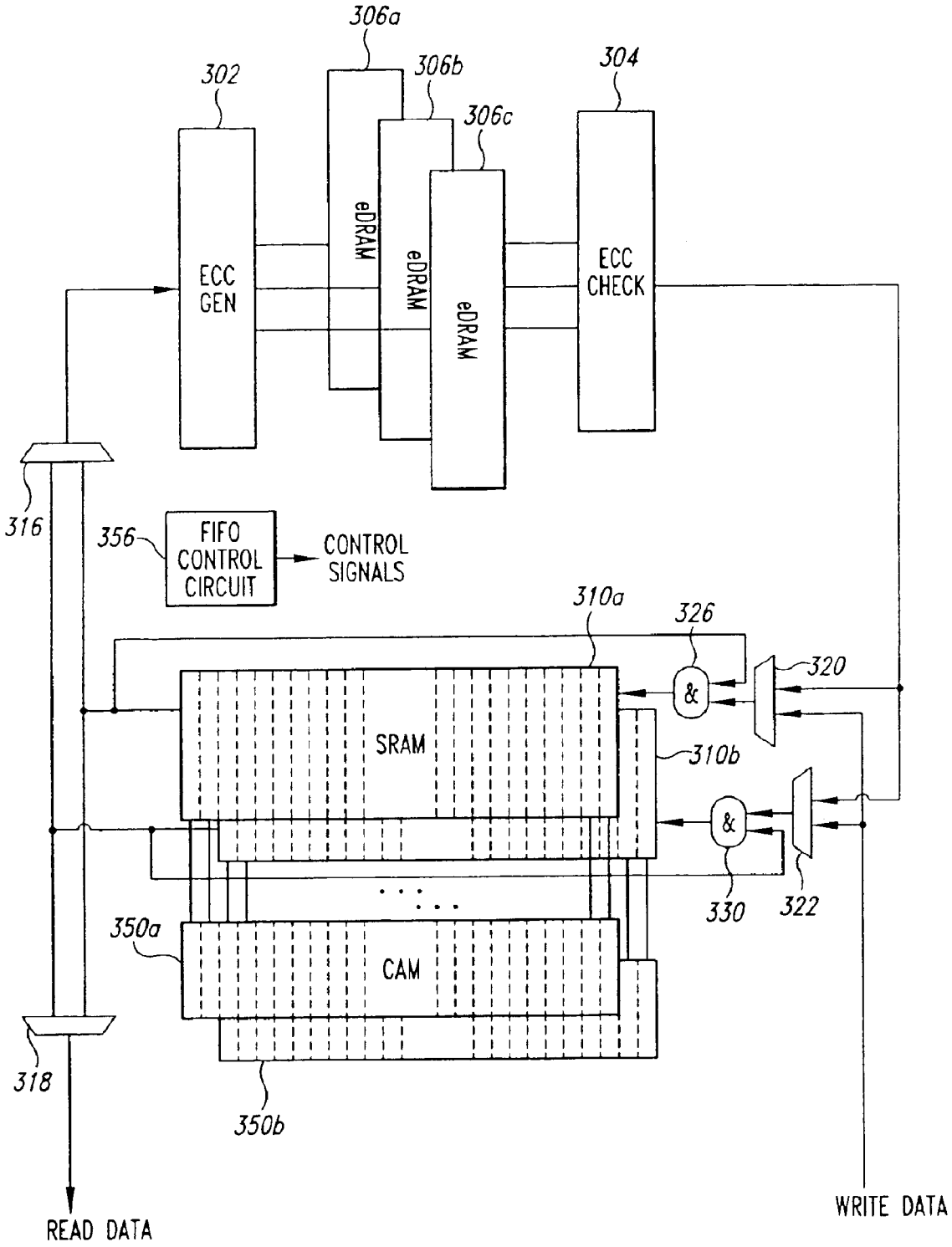
FIG. 3 is a block diagram of a portion of a memory system according to an embodiment of the present invention.

Illustrated in FIG. 3 is portion of a memory system according to an embodiment of the present invention. An error correction code (ECC) generator 302 and ECC checking circuitry 304 are coupled to the input and output busses of an embedded memory 306. The embedded memory 306 is illustrated as having multiple banks of single-ported embedded memory 306*a-c*. Although only three banks are shown in FIG. 3, it will be appreciated that the number of banks of embedded memory can be modified without departing from the scope of the present invention. The ECC generator and checking circuitry 302 and 304, as well as the embedded memory 306, are conventional and can be implemented using a variety of circuitry and techniques well-known to those of ordinary skill in the art.

Coupled to the ECC generator 302 and the ECC checking circuitry 304 is a memory 310. The memory 310 is divided into memories 310*a* and 310*b*, each being arranged in a first-in-first-out (FIFO) fashion. The output of the memories 310*a* and 310*b* are coupled to selection circuits 316 and 318. The selection circuit 316 selectively couples data from either the memory 310*a* or the memory 310*b* to the ECC generator 302 for calculation of an error correction code and storage in the embedded memory 306. The selection circuit 318, on the other hand, selects data from the memories 310*a* and 310*b* to be provided in response to a read command issued to the embedded memory 306. Coupled to the input of memories 310*a* and 310*b* through combinatorial circuits 326 and 330 are selection circuits 320 and 322, all respectively. The selection circuits 320 and 322 selectively provide to the input of the memories 310*a* and 310*b* either the output of the embedded memory 306 and the ECC generator 302, or data being written to the embedded memory 306. The combinatorial circuits 326 and 330 are coupled to receive both the output of a respective selection circuit, and the output of the memory to which the combinatorial circuit is coupled. Thus, the output of the selection circuits 320 and 322 may be combined by combinatorial circuits 326 and 330 with the output of the respective memories 310*a* and 310*b*. As will be explained in more detail below, partial write data may be combined with pre-processed data stored in the memories 310*a* and 310*b* by the combinatorial circuits 326 and 330 to facilitate the calculation of error correction codes when writing the data back to the embedded memory 306. In a partial write operation, only a portion of the total length of the data read is modified. Thus, data previously stored in the memory 310 can be updated with the modified portion, and subsequently, the updated data can be used for calculating a new error correction code.

A content addressable memory (CAM) 350 is coupled to the memory 310. The CAM 350 is divided into CAMs 350*a* and 350*b*, which are coupled to the memories 310*a* and 310*b*, respectively, for maintaining organization of data stored in the memories 310*a* and 310*b*, and to allow for data to be stored and accessed by the respective memory address. The CAMs 350*a* and 350*b* are coupled to receive memory addresses of read and write operations directed to the embedded memory 306. Each location in which a memory address can be stored in the CAMs 350*a* and 350*b* corresponds to a memory location in the memories 310*a* and 310*b*, respectively, into which data can be stored. Upon receiving a memory address for a read or write operation that matches one of the addresses stored in either CAM 350*a* or 350*b*, data can be read from or written to the associated memory location in the memory 310.

Control of the selection circuits 316, 318, 320, and 322, and the combinatorial circuits 326 and 330 are delegated to a FIFO control circuit 356. Coordination of reading and writing data and memory addresses to the memory 310 and the CAM 350 are also under the control of the FIFO control circuit 356. As will be explained in more detail below, the FIFO control circuit 356 coordinates the operation of the selection circuits 316, 318, 320, and 322 with the operation of the combinatorial circuits 326 and 330, and the memory 310 and the CAM 350 such that high read and write bandwidth of an embedded memory system having ECC capability can be maintained with minimal performance costs.

As mentioned previously, the selection circuits 316 and 318 selectively couple the output of the memories 310*a* and 310*b* to provide data to the ECC generator 302 and the embedded memory 306, or to provide data to a requesting entity in response to a read operation. The selection circuits 320 and 330 similarly selectively couple the input of the memories 310*a* and 310*b* to receive data from the embedded memory 306 and ECC check circuitry 304, or to receive write data. In an embodiment of the present invention, the memories 310*a* and 310*b* provide data to and receive data from a graphics processing pipeline as described in U.S. patent application Ser. No. 09/736,861, entitled MEMORY SYSTEM AND METHOD FOR IMPROVED UTILIZATION OF READ AND WRITE BANDWIDTH OF A GRAPHICS PROCESSING SYSTEM to Radke, filed Dec. 13, 2001, which is incorporated herein by reference. In summary, the graphics processing pipeline and memory system described therein provides for uninterrupted read-modify-write operations in a memory having multiple single-ported banks of embedded memory. The multiple banks of memory are interleaved to allow data to be modified by the processing pipeline to be written to one bank of the embedded memory while reading pre-processed data from another bank. Another bank of the memory is pre-charged during the reading and writing operation in the other memory banks in order for the read-modify-write operation to continue into the precharged bank uninterrupted. As explained in more detail in the aforementioned patent application, the length of the graphics processing pipeline is such that after reading and processing data from a first bank, reading of pre-processed data from a second bank may be performed while writing modified data back to the bank from which the pre-processed data was previously read.

The operation of the memory system illustrated in FIG. 3 will now be described briefly, followed by a more detailed description of its operation.

The memories 310*a* and 310*b* allow for data that has been read from the embedded memory 306 to be temporarily stored in its pre-processed form during the processing of that data, and then for the pre-processed data to be later combined with the resulting post-processed data before being written back to the embedded memory 306. Thus, where only a portion of the of the original data is modified during the processing, the partial write data can be combined with the pre-processed data located in the memory 310, and calculation of the error correction code by the ECC generator 302 for the modified data can be performed in-line when writing the data back to the embedded memory 306. This technique avoids the need to read the pre-processed data a second time from the embedded memory 306 in order to calculate the correct ECC when performing a partial write operation.

In operation, when data is requested from the embedded memory 306, the memory address of the requested data is stored in one of the CAMs 350*a* or 350*b*. As will be explained in more detail below, the particular CAM into which the memory address is written may be based on whether the memory address is even or odd. The requested data is read from the embedded memory 306 and the error code associated with requested data is compared by the ECC check circuitry 304 to confirm the integrity of the data. Corrections to the requested data are made if necessary and if possible. The requested data is then written in its pre-processed form to the memory location of memory 310*a* or memory 310*b* that is associated with the location in the CAM 350 to which the memory address is written. Thus, when the address is provided again to the CAM 350, the pre-processed data will be accessed in the associated memory location of memory 310. As mentioned previously, coordination of the CAM 350, the selection circuits 320 and 322, and the combinatorial circuits 326 and 330, are controlled by the FIFO control circuit 356 in order to write the requested data into the appropriate memory location of the memory 310. The requested data is further output to the selection circuit 318 to be provided to the requesting entity.

In the case where the data has been requested for processing, for example, through a graphics processing pipeline, the post-processed data may need to be written back to the location in the embedded memory 306 from which the data in its pre-processed from was retrieved. Further complicating the matter is that in the case of a partial write, it may be that only a portion of the entire data has been modified by the processing. Consequently, when writing the modified data back to the embedded memory 306, a new error correction code will need to be calculated. In this situation, the entire length of data must be available and then combined with the partial write data before a new error correction code can be correctly calculated. In a conventional memory system, obtaining the full length of the pre-processed data requires a second read from the embedded memory, thus resulting in delays caused by the inherent memory access latency. Where data is being processed through a graphics processing pipeline such as one described in the aforementioned patent application, the additional delays in obtaining the pre-processed data, combining that data with the partial write data, and then calculating a new error correction code, will significantly reduce the processing throughput.

In contrast to conventional memory systems, when performing a partial write in embodiments of the present invention, a second access to the embedded memory 306 can be avoided because the pre-processed data is already present in the memory 310 from when the data was originally read from the embedded memory 306. Upon performing the partial write, the partial write data is provided to selection circuits 320 and 322, and the memory address to which the partial write is directed is provided to the CAM 350. As a result of the pre-processed data being stored in the memory 310, and being indexed according to its address, which is stored in the CAM 350, receipt of the matching memory address by the CAM 350 will result in the pre-processed data being output by the memory 310. The pre-processed data is provided from the output of the memory 310 to the respective combinatorial circuit 326 or 330. The FIFO control circuit 356 directs the selection circuits 320 and 322 to provide at the respective outputs the partial write data, and then activates the combinatorial circuits 326 and 330. As a result, the combinatorial circuit, having the pre-processed data and the partial write data applied to its inputs, will produce modified data including the partial write data that can be written back to the embedded memory 306.

The modified data is then provided to the inputs of the selection circuits 316 and 318. The FIFO control circuit 356 directs the selection circuit 316 to couple the output of the memories 310*a* or 310*b*, that is, the output of whichever memory had been storing the pre-processed data, to the input to the ECC generator 302. An error correction code is calculated, and the write operation is completed when the modified post-processed data is written to the memory location in the embedded memory 306 that corresponds to the write address applied to the CAM 350.

Although the previous example described the use of only one of the memories of the memory 310 and one of the CAMs of the CAM 350, having two memories 310*a* and 310*b* and two CAMs 350*a* and 350*b* are preferred. As illustrated in FIG. 3, the memory 310 is divided into memories 310*a* and 310*b*, and the CAM 350 divided into CAMs 350*a* and 350*b*, each CAM coupled to a respective memory 310*a* and 310*b* in order to provide organization and access. It will be appreciated that selection of the memory 310*a* or 310*b* into which data will be written may be made based on several criteria, such as, whether the memory address of the data is even or odd, or the physical location of the array from which the data is retrieved. By having two sets of memories 310*a* and 310*b*, and CAMs 350*a* and 350*b*, reading and writing operations can be interleaved between the two memory and CAM sets to allow for efficient use of the read and write busses of the embedded memory 306.

For example, when a first read command is issued, the first read address is stored in CAM 350*a* and the first pre-processed read data returned by the embedded memory 306 is stored in the associated memory location in the memory 310*a*. The first pre-processed read data is also provided to the requesting entity through the selection circuit 318, which is under the control of the FIFO control circuit 356. Concurrently with the execution of the first read command, a first write command is issued. The first write address is applied to the CAM 350*b* and the first post-processed write data is applied to the input of the selection circuits 320 and 322. Assuming that the pre-processed data that yielded the first post-processed write data is present in the memory 310*b*, application of the address to the CAM 350*b* results in the pre-processed data being output to the combinatorial circuit 330. Under the control of the FIFO control circuit 356, the selection circuit 322 selects the write data to be applied to the combinatorial circuit 330 in order to be combined with the pre-processed data. The resulting modified data is then output and provided through the selection circuit 316 to ECC generator 302 to be written back to the embedded memory 306.

At a time following the completion of the first read and write operations, a second read command is issued. A second read address for the second read command is directed to and stored in the CAM 350*b*, and a second pre-processed read data from the embedded memory 306 is stored in an associated memory location in the memory 310*a*. The selection circuit 318 is then directed by the FIFO control circuit 356 to provide the second pre-processed read data to the requesting entity. Concurrently, a second write command is issued. It will be assumed that the pre-processed data that yielded the second post-processed write data is present in the memory 310*a*. Thus, application of the address to the CAM 350*a* results in the pre-processed data being output to the combinatorial circuit 320. The selection circuit 322 is commanded to select the second post-processed write data to be applied to the combinatorial circuit 320 in order to be combined with the pre-processed data just output by the memory 310*a*. To complete the second write command, the resulting combined data is then output and provided through the selection circuit 316 to ECC generator 302 to be written back to the embedded memory 306.

As illustrated by the previous example, interleaving the use of the memory and CAM sets, 310*a* and 350*a*, and 310*b* and 350*b*, allows for read and write commands to be performed relatively concurrently. This feature is desirable where data is being processed through a graphics processing pipeline such as the one described in the aforementioned patent application. That is, the error correction capability of embodiments of the present invention can be combined with the read-modify-write technique provided by the processing pipeline structure and method to provide improved utilization of the read and write bandwidth of a graphics processing system while still including error correction capability.

It will be appreciated that the capacity or length of the memories 310*a* and 310*b* can be adjusted according the to desired functionality of the system. Where the memory and CAM pairs will be used with a graphics pipeline as described in the aforementioned patent, the memories 310*a* and 310*b* should be of sufficient length to accommodate the write-back portion of a read-modify-write operation to the memory array from which the original data was retrieved. The length of the memory may also be adjusted based on the space available. It will be further appreciated that the description provided herein, although well-known circuits, control signals, timing protocols, and software operations have not been shown in detail in the interest of brevity, is sufficient to enable one of ordinary skill in the art to practice the present invention.

From the foregoing it will also be appreciated that, although specific embodiments of the invention have been described herein for purposes of illustration, various modifications may be made without deviating from the spirit and scope of the invention. Accordingly, the invention is not limited except as by the appended claims.

What is claimed is:

1. In a graphics processing system having a memory system including an embedded memory array and having error-correction coding, a method for accessing the embedded memory array, comprising:

reading data and an associated error correction code from a location corresponding to a memory address in the embedded memory array;

storing the data at a buffer location in a buffer memory having a plurality of buffer locations for storing a plurality of data;

storing the memory address:

processing at least a portion of the data to provide modified data;

receiving write memory addresses; and when writing the modified data to the embedded memory array in response to a write memory address matching the stored memory address, logically combining the stored data and the modified data and storing the combined data at the buffer location;

calculating a new error correction code based on the combined data in the buffer memory; and storing the combined data and the new error correction code to the location corresponding to the memory address in the embedded memory array.

2. The method of claim 1 wherein processing at least a portion of the data to provide modified data comprises performing graphics processing operations on the data.

3. The method of claim 1, further comprising:

substantially concurrent with the reading and storing of data, updating second data previously stored in a second memory with a modified portion of the second data; and substantially concurrent with the updating of the data, reading third data and storing the third data in the second memory.

4. The method of claim 1, further comprising providing the data read from the location to an output bus for provision to a requesting entity.

5. The method of claim 1 wherein storing the data at a buffer location in a buffer memory comprises storing the data at a buffer location in a first-in-first-out (FIFO) buffer.

6. In a graphics processing system having a memory system including an embedded memory array and having error-correction coding, a method for accessing the embedded memory array, comprising:

reading first data and an associated error correction code from a first location corresponding to a first memory address in the embedded memory array;

storing the first data at a first buffer location in a first buffer memory having a plurality of buffer locations for storing a plurality of data;

substantially concurrent with the reading and storing of the first data in the first buffer memory, logically combining second data previously stored at a second buffer location in a second buffer memory with modified data;

calculating a new error correction code based on the combined updated second data in the second buffer memory; and storing the combined second data and the new error correction code to a second location corresponding to a second memory address in the embedded memory array from which the second data was originally read;

processing at least a portion of the first data to provide first modified data;

reading third data from a third location corresponding to a third memory address in the embedded memory array;

storing the third data at a third buffer location in the second buffer memory; and substantially concurrent with the reading and storing of the third data, logically combining the first data stored at the first buffer location in the first buffer memory with the first modified data;

calculating a new error correction code based on the combined updated first data in the first buffer memory; and storing the combined first data and the new error correction code to the first location corresponding to the first memory address in the embedded memory array.

7. The method of claim 6 wherein processing at least a portion of the first data to provide first modified data comprises performing graphics processing operations on the first data.

8. The method of claim 6, further comprising providing the first data to an output bus for provision to a requesting entity.

9. The method of claim 6 wherein storing the first data at a first buffer location in a first buffer memory comprises storing the first data at a first buffer location in a first-in-first-out (FIFO) buffer.

10. A memory system, comprising:

an embedded memory having a read data port and a write data port;

an error-correction code (EGG) generator coupled to the write data port and configured to generate an associated EGG for data written to the embedded memory;

an ECC check circuit coupled to the read data port and configured to confirm the integrity of the data based on the associated EGG;

a memory having an output coupled to the EGG generator and further having an input coupled to the EGG check circuit, the memory configured to store data read from the embedded memory and to store a memory address associated with the stored data, the memory further configured to output the stored data associated with a memory address in response to receiving the same;

a first selection circuit having an input coupled to the output of the memory, and a first output coupled to a read bus and a second output coupled to the EGG generator and the write data port;

a second selection circuit having an output, and further having a first input coupled to the EGG check circuit and a second input coupled to a write bus;

combination logic having an output coupled to the input of the memory, a first input coupled to the output of the memory and a second input coupled to the EGG check circuit, the combination logic configured to combine data applied to the first and second inputs and provide combined data at the output; and a control circuit coupled to the first and second selection circuits, the memory, and the combination logic, the control circuit configured to control the first and second selection circuits and coordinate the storing of data from the embedded memory in the memory and provide the data to an output bus, and in response to receiving a write request, coordinate the combining of modified data received from the write bus with corresponding original data previously stored in the memory and further provide the combined data for EGG calculation and writing to the memory location in the embedded memory from where the original data was read.

11. The apparatus of claim 10, further comprising:

a second memory an output coupled to the EGC generator and an input coupled to the EGG check circuit, the second memory configured to store data read from the embedded memory and to store a memory address associated with the stored data, the memory further configured to output the stored data associated with a memory address in response to receiving the same;

second combination logic having an output coupled to the second memory, a first input coupled to the output of the second memory, and a second input coupled to the EGG check circuit, the second combination logic configured to combine data applied to the first and second inputs and provide combined data at the output.

12. The apparatus of claim 11, wherein the control circuit is further configured to coordinate the storing of data from the embedded memory in the second memory and provide the data to the output bus, and in response to receiving a write request, coordinate the combining of modified data received from the write bus with corresponding original data previously stored in the second memory and further provide the combined data for EGG calculation and writing to the memory location in the embedded memory from where the original data was read.

13. The apparatus of claim 10 wherein the memory comprises a static random access memory.

14. The apparatus of claim 10 wherein the embedded memory comprises a dual-port embedded memory.

15. The apparatus of claim 10 wherein the memory comprises a first-in-first-out (FIFO) buffer.

* * * * *

UNITED STATES PATENT AND TRADEMARK OFFICE

CERTIFICATE OF CORRECTION

PATENT NO. : 6,956,577 B2
APPLICATION NO. : 10/813184
DATED : October 18, 2005
INVENTOR(S) : William Radke and Atif Sarwari It is certified that error appears in the above-identified patent and that said Letters Patent is hereby corrected as shown below:

| Column, Line | Reads | Should Read |
|---|---|---|
| Column 2, Line 14 | "space on an graphics" | --space on a graphics-- |
| Column 3, Line 62 | "operator or an" | --operator of an-- |
| Column 4, Line 33 | "a bus interface-**200**" | --a bus interface **200**-- |
| Column 4, Line 35 | "optionally high-speed" | --optionally to high-speed-- |
| Column 5, Line 3 | "is portion" | --is a portion-- |
| Column 5, Lines 15-16 | "techniques well-known" | --techniques well known-- |
| Column 6, Line 54 | "portion of the of the original" | --portion of the original-- |
| Column 7, Line 4 | "with requested data" | --with the requested data-- |
| Column 8, Line 13 | "CAM **350** divided into" | --CAM **350** is divided into-- |
| Column 8, Line 18 | "such as, whether the" | --such as whether-- |
| Column 9, Line 13 | "according the to" | --according to the-- |
| Column 9, Line 45 | "memory address:" | --memory address;-- |
| Column 10, Line 45 | "combined updated first data" | --combined first data-- |

UNITED STATES PATENT AND TRADEMARK OFFICE

CERTIFICATE OF CORRECTION

PATENT NO. : 6,956,577 B2
APPLICATION NO. : 10/813184
DATED : October 18, 2005
INVENTOR(S) : William Radke and Atif Sarwari It is certified that error appears in the above-identified patent and that said Letters Patent is hereby corrected as shown below:

| | | |
|---|---|---|
| Column 10, Line 65 | "(EGG) generator" | --(ECC) generator-- |
| Column 10, Line 67 | "EGG" | --ECC-- |
| Column 11, Lines 3, 4, 5, 13, 16, 21 and 34 | "EGG" | --ECC-- |
| Column 12, Line 4 | "a second memory an output coupled to the EGC generator" | --a second memory output coupled to the ECC generator-- |
| Column 12, Lines 5, 14 and 24 | "EGG" | --ECC-- |

Signed and Sealed this

Nineteenth Day of December, 2006

JON W. DUDAS
*Director of the United States Patent and Trademark Office*